US009839991B2

(12) United States Patent
Whittaker

(10) Patent No.: US 9,839,991 B2
(45) Date of Patent: Dec. 12, 2017

(54) TEXTURED ABRASIVE ARTICLE AND RELATED METHODS

(71) Applicant: 3M INNOVATIVE PROPERTIES COMPANY, St. Paul, MN (US)

(72) Inventor: Kim E. Whittaker, Warwickshire (GB)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 0 days.

(21) Appl. No.: 15/511,698

(22) PCT Filed: Oct. 2, 2015

(86) PCT No.: PCT/US2015/053649
§ 371 (c)(1),
(2) Date: Mar. 16, 2017

(87) PCT Pub. No.: WO2016/057319
PCT Pub. Date: Apr. 14, 2016

(65) Prior Publication Data

US 2017/0282333 A1 Oct. 5, 2017

Related U.S. Application Data

(60) Provisional application No. 62/060,677, filed on Oct. 7, 2014.

(51) Int. Cl.
*B24D 11/02* (2006.01)
*B24D 3/00* (2006.01)
(Continued)

(52) U.S. Cl.
CPC ..... *B24D 11/02* (2013.01); *B24B 37/042* (2013.01); *B24D 3/002* (2013.01); *B24D 11/005* (2013.01)

(58) Field of Classification Search
CPC ..... B24B 37/042; B24D 11/02; B24D 3/002; B24D 11/005
(Continued)

(56) References Cited

U.S. PATENT DOCUMENTS

| | | | |
|---|---|---|---|
| 2,958,593 | A | 11/1960 | Hoover |
| 4,927,431 | A | 5/1990 | Buchanan |

(Continued)

FOREIGN PATENT DOCUMENTS

| | | |
|---|---|---|
| EP | 0 198 713 | 10/1986 |
| WO | 2010/077826 | 7/2010 |
| WO | 2016/057279 | 4/2016 |

*Primary Examiner* — Robert Rose
(74) *Attorney, Agent, or Firm* — Aleksander Medved

(57) ABSTRACT

Provided are multilayered abrasive articles that include an abrasive composite having shaped features, a carrier film, and a nonwoven web, where the nonwoven web and the carrier film have respective patterns of discrete, three-dimensional protrusions that are aligned with each other. A compressible foam backing extending across a major surface of the nonwoven web opposite the carrier film. Further provided are multilayered abrasive articles that include an abrasive composite, a carrier film, and a non-woven web. The nonwoven web and the carrier film have respective patterns of discrete, three-dimensional protrusions that are aligned with each other and the shaped features and the three-dimensional protrusions of the nonwoven web have an average diameter:average diameter ratio ranging from 1:50 to 1:5.

15 Claims, 3 Drawing Sheets

(51) Int. Cl.
*B24D 11/00* (2006.01)
*B24B 37/04* (2012.01)

(58) Field of Classification Search
USPC ..... 451/526, 527, 528, 536, 539, 533, 534, 451/41; 51/293, 297, 298
See application file for complete search history.

(56) References Cited

U.S. PATENT DOCUMENTS

| | | | | |
|---|---|---|---|---|
| 5,014,468 | A | 5/1991 | Ravipati | |
| 5,152,917 | A | 10/1992 | Pieper | |
| 5,201,101 | A | 4/1993 | Rouser | |
| 5,254,194 | A | 10/1993 | Ott | |
| 5,378,251 | A | 1/1995 | Culler | |
| 5,611,825 | A | 3/1997 | Engen | |
| 5,942,015 | A | 8/1999 | Culler | |
| 6,200,840 | B1 | 3/2001 | Chen | |
| 6,261,682 | B1 | 7/2001 | Law | |
| 6,277,160 | B1 | 8/2001 | Stubbs | |
| 6,846,232 | B2 | 1/2005 | Braunschweig | |
| 6,929,539 | B2 | 8/2005 | Schutz | |
| 2002/0090901 | A1 | 7/2002 | Schutz | |
| 2003/0022604 | A1 | 1/2003 | Annen | |
| 2003/0207659 | A1 | 11/2003 | Annen | |
| 2005/0159088 | A1 | 7/2005 | Smith | |
| 2007/0066186 | A1 | 3/2007 | Annen | |
| 2007/0243798 | A1* | 10/2007 | Annen | B24D 3/002 451/28 |
| 2010/0167630 | A1 | 7/2010 | Chung-fat | |

* cited by examiner

TEXTURED ABRASIVE ARTICLE AND RELATED METHODS

CROSS REFERENCE TO RELATED APPLICATIONS

This application is a national stage filing under 35 U.S.C. 371 of PCT/US2015/053649, filed Oct. 2, 2015, which claims the benefit of U.S. Provisional Application No. 62/060,677, filed Oct. 7, 2014, the disclosures of which are incorporated by reference in their entirety herein.

FIELD OF THE INVENTION

Provided herein are abrasive articles and related methods. The provided abrasive articles are usable for surface finishing applications, such as the polishing of painted automotive exteriors.

BACKGROUND

There are widespread industrial applications where abrasive articles are needed to produce a desired surface finish. Specific applications include, for example, the polishing of glossy surfaces found in automotive and marine clearcoat finishes and lacquer finishes. Other applications include cleaning or scuffing operations on the surfaces of metals, woods, plastics, and composites. To produce a desired surface finish, service providers often use flexible abrasive pads, which can be manipulated by hand or using a motorized power tool. Such abrasive pads are capable of removing material from the surface of a workpiece (or substrate) in a controlled fashion to remove minor defects.

Certain abrasive articles, generically referred to as "structured abrasive" articles, have been sold commercially for use in the manufacture and repair of glossy surface finishes. These articles have a structured abrasive layer affixed to a backing, where the structured abrasive layer represents a plurality of tiny, shaped abrasive composites, characterized by abrasive particles embedded in a polymeric binder. The shaped abrasive composites can be formed into pyramids or other precise geometric shapes. Examples of such structured abrasive articles include those marketed under the trade designation "TRIZACT," by 3M Company, St. Paul, Minn.

Alternatively, abrasive articles can be made by coating a sequence of layers onto a flexible backing, such as paper, to form a coated abrasive. For example, a first resin can be initially deposited onto the backing to provide a make coat. Abrasive grains are then added and tacked down to the backing by the make coat. A second resin, called a size coat, is then coated over both the make coat and the abrasive particles. Optionally, additional coats can be added. When hardened, the resins effectively secure the particles to the backing.

In many applications, the flexible abrasive article is moistened with water or some other liquid, optionally containing a surfactant, which acts to lubricate and remove swarf and debris from the abrading surfaces. Two problems are known to arise when performing these so called wet sanding operations. The first is known as "stiction," a phenomenon where the damp abrasive tends to bind and "stick" to the workpiece as a result of surface tension. Stiction can result in loss of user control over the abrading operation and consequent damage to the workpiece. The second is hydroplaning, which occurs when the abrasive and workpiece become separated by a thin layer of the liquid.

This can cause the abrasive to skid across the surface without directly contacting the workpiece, degrading cut performance.

SUMMARY

The provided abrasive articles answer the problems of stiction and hydroplaning by dynamically redistributing the liquid present at the abrasive-substrate interface along a plurality of channels disposed along the working surface of the article. These channels are formed by layering a structured abrasive layer onto a thin carrier film, which is coupled to a textured nonwoven web, and which is then disposed on a foam backing. A surface texture is formed through the carrier film and structured abrasive layer by the nonwoven web, thereby managing the accumulation of liquid and swarf at the interface. The carrier film further provides improved structural integrity of the abrasive layer, particularly when under tension.

In one aspect, an abrasive article is provided. The abrasive article comprises: a carrier film having opposed first and second major surfaces; an abrasive composite comprising a plurality of shaped features, the abrasive composite being disposed on the first major surface of the carrier film; a nonwoven web disposed on the second major surface of the carrier film, wherein the nonwoven web and the carrier film have respective patterns of discrete, three-dimensional protrusions that are aligned with each other; and a foam backing extending across a major surface of the nonwoven web opposite the carrier film, wherein the foam backing is resiliently compressible.

In another aspect, an abrasive article comprising: a carrier film having opposed first and second major surfaces; an abrasive composite comprising a plurality of shaped features, the abrasive composite being disposed on the first major surface of the carrier film; and a nonwoven web disposed on the second major surface of the carrier film, wherein the nonwoven web and the carrier film have respective patterns of discrete, three-dimensional protrusions that are aligned with each other, wherein the shaped features of the abrasive composite and three-dimensional protrusions of the nonwoven web have an average diameter:average diameter ratio ranging from 1:50 to 1:5.

In still another aspect, a method of abrading a substrate using the provided abrasive article is provided, the method comprising: applying a liquid to either the abrasive article or the substrate; and placing the abrasive article in frictional contact with the substrate, whereby the pattern of three-dimensional protrusions provide channels that dynamically distribute the liquid along an interface between the abrasive composite and the substrate.

In yet another aspect, a method of making an abrasive article is provided, comprising: disposing an abrasive composite onto a conformable carrier film to provide a coated abrasive layer; and disposing the coated abrasive layer onto a nonwoven web having a pattern of three-dimensional protrusions to transfer the pattern of three-dimensional protrusions onto a major surface of the coated abrasive layer facing away from the nonwoven web.

DEFINITIONS

As used herein:

"compressible" means capable of decreasing in volume upon the application of normal compressive forces typically encountered in an abrading operation;

"diameter" refers to the longest dimension of a given shape or object as normally projected onto the planar working surface of an abrasive article;

"resilient" means capable of returning to an original shape or position, as after being stretched or compressed; and "three-dimensional" means having raised portions and recessed portions.

DETAILED DESCRIPTION

Figure 1A:
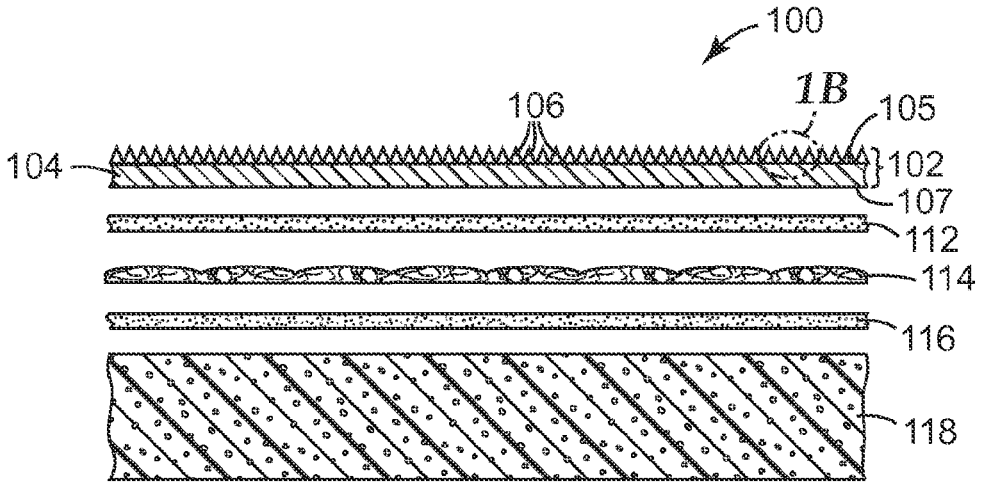
FIG. 1A is an exploded, elevational cross-sectional view of a multi-layered abrasive article according to a first exemplary embodiment.

FIG. 1A shows the constituent layers of an exemplary multi-layered abrasive article hereinafter designated by the numeral 100. In FIG. 1A, which is not drawn to scale, the abrasive article 100 includes a plurality of layers that are coupled to each other in a consolidated, sheet-like configuration.

Representing the working surface of the abrasive article 100 is a flexible abrasive layer 102. As illustrated, the flexible abrasive layer 102 comprises a carrier film 104 with opposing first and second major surfaces 105, 107. Disposed on the first major surface 105 are a plurality of shaped, abrasive composites 106. The abrasive composites 106 are generally comprised of abrasive particles uniformly mixed with a binder to form a slurry, which is then hardened on the surface of a backing. The binder itself is preferably erodible such that direct frictional contact between the abrasive particles and the substrate can be maintained even as the flexible abrasive layer 102 gradually wears away during use.

Details concerning materials and methods for making abrasive composites, generally, may be found, for example, in U.S. Pat. No. 4,927,431 (Buchanan et al.); U.S. Pat. No. 5,014,468 (Ravipati et al.); U.S. Pat. No. 5,378,251 (Culler et al.); U.S. Pat. No. 5,942,015 (Culler et al.); U.S. Pat. No. 6,261,682 (Law); and U.S. Pat. No. 6,277,160 (Stubbs et al.); U.S. Pat. No. 6,929,539 (Annen et al.); and U.S. Patent Publication No. 2003/0207659 (Annen et al.).

Figure 1B:
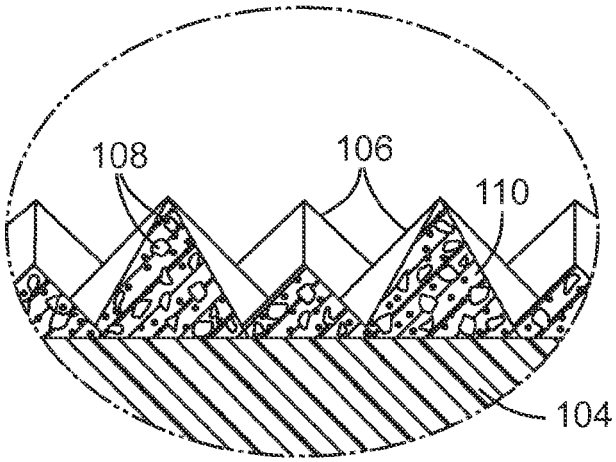
FIG. 1B is an enlarged view of a portion of the abrasive article of FIG. 1A.

FIG. 1B shows, in more detail, abrasive composites 106 formed by molding a structured abrasive against the carrier film 104. Structured abrasive articles are generally prepared by mixing a slurry of abrasive particles 108 and hardenable precursor of a suitable binder resin (or binder precursor 110), casting the slurry between the carrier film 104 and a releasable mold or pattern, then hardening the binder precursor to produce an array of tiny and precisely replicated abrasive composites 106 affixed to the carrier film 104. The hardening of the binder can be achieved by exposure to an energy source. Such energy sources can include, for example, thermal energy and radiant energy derived from an electron beam, ultraviolet light, or visible light. The respective patterns of three-dimensional protrusions are preferably molded, replicated patterns.

The abrasive particles are not subject to any particular limitations and may be composed of any of a wide variety of hard minerals known in the art. Examples of suitable abrasive particles include, for example, fused aluminum oxide, heat treated aluminum oxide, white fused aluminum oxide, black silicon carbide, green silicon carbide, titanium diboride, boron carbide, silicon nitride, tungsten carbide, titanium carbide, diamond, cubic boron nitride, hexagonal boron nitride, garnet, fused alumina zirconia, alumina-based sol gel derived abrasive particles, silica, iron oxide, chromia, ceria, zirconia, titania, tin oxide, gamma alumina, and combinations thereof. The alumina abrasive particles may contain a metal oxide modifier. The diamond and cubic boron nitride abrasive particles may be monocrystalline or polycrystalline.

In nearly all cases there is a range or distribution of abrasive particle sizes. The number average particle size of the abrasive particles may range from between 0.001 and about 300 micrometers, between about 0.01 and about 250 micrometers, or between about 0.02 and about 100 micrometers. Here, the particle size of the abrasive particle is measured by the longest dimension of the abrasive particle.

The carrier film 104 is also not particularly restricted but preferably has a flexibility and conformability sufficient to allow substantial contact between the abrasive particles 108 and the substrate to be abraded. For example, the carrier film 104 can be made from a polymeric film, primed polymeric film, metal foil, cloth, paper, vulcanized fiber, nonwovens, treated versions thereof, and combinations thereof. Suitable carrier films, for example, include elastomeric polyurethane films.

In some embodiments, the carrier film 104 has a thickness that is generally uniform across its major surfaces. The average thickness of the backing may be at least 10 micrometers, at least 20 micrometers, at least 50 micrometers, at least 60 micrometers, or at least 75 micrometers. On the upper end, the average thickness of the backing may be at most 200 micrometers, at most 150 micrometers, at most 100 micrometers, at most 75 micrometers, or at most 50 micrometers. To enhance adhesion between the abrasive coating and the carrier film 104, the carrier film 104 may be chemically primed or otherwise surface treated, for example by corona treatment, UV treatment, electron beam treatment, flame treatment, or surface roughening.

Optionally, and as further depicted in FIG. 1A, the flexible abrasive layer 102 is adhesively coupled to the layers beneath it by a first adhesive layer 112. In this exemplary embodiment, the first adhesive layer 112 contacts the carrier film 104 along its second major surface 107 and couples the carrier film 104 to a nonwoven web 114. Although not shown here, the carrier film 104 could also be directly laminated to the second major surface 107 of the nonwoven web 114, where the carrier film 104 and nonwoven web 114 are mutually secured by polymer chain entanglement at the interface.

Illustrated in FIG. 1A, the nonwoven web 114 is a textured nonwoven web having a structured major surface facing toward the flexible abrasive layer 102. The structured major surface has a three-dimensional pattern sufficiently prominent to produce a superimposed, conformal pattern on its neighboring layers. In exemplary embodiments, the three-dimensional pattern is represented by a two-dimensional array of discrete protrusions. In exemplary embodiments, the features of the three-dimensional pattern are separated from each other by a plurality of intersecting channels extending parallel the first and second major surfaces 105, 107.

Figure 5:
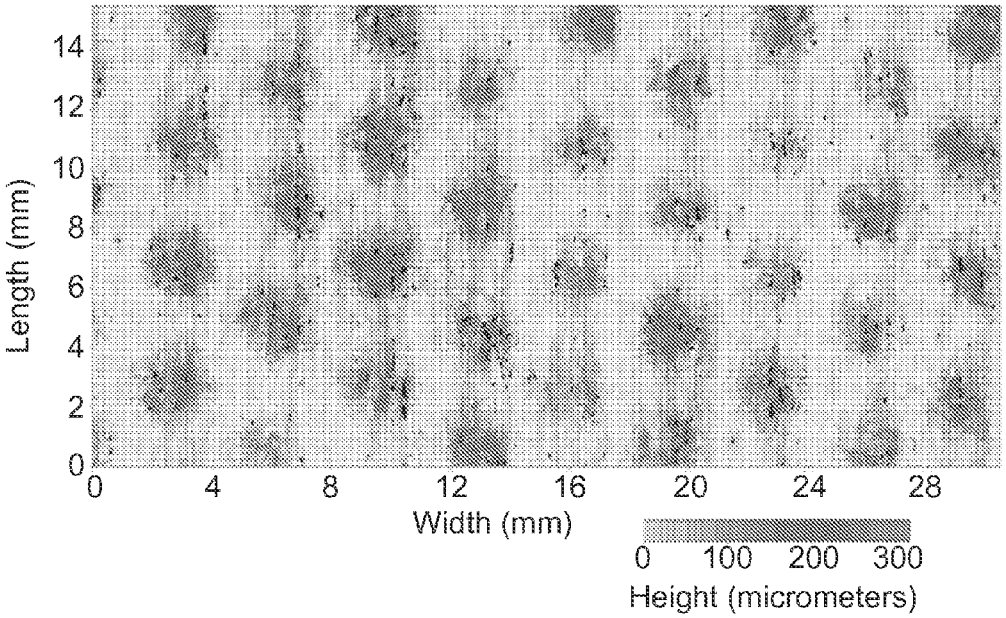
FIG. 5 is a topographical representation of a prototype abrasive article.

A three-dimensional pattern of protrusions associated with an actual abrasive article is shown in FIG. 5 and described in greater detail in the Examples section. The image of FIG. 5 was obtained using a MikroCAD Lite Fringe Projection 3D Profilometer (GF Messtechnik GmbH, Berlin, Germany). As shown, the protrusions are represented as a two-dimensional staggered array of dots spread across the working surface of the abrasive article.

It is preferred that the carrier film 104 and abrasive composites 106 are both flexible and fairly thin, so that the abrasive layer 102 partially or fully assumes the shape and surface texture of the underlying nonwoven web 114. As a result, the nonwoven web 114 and the carrier film 104 have respective patterns of discrete, three-dimensional protrusions that are aligned with each other.

The three-dimensional protrusions could take the form of any of a number of different shapes. The shapes may include the protruding shapes represented by hemispheres, pyramids, posts, prisms, or other geometric shapes and combinations thereof.

The shapes could be irregular in nature. For example, the protrusions could appear as islands with irregular boundaries and optionally have a distribution of shapes and/or sizes. The boundaries themselves may not be sharply defined; for example, the protrusions may have sloping sidewalls.

The height of the three-dimensional protrusions is ideally uniform, but in practice tends to vary considerably about an average value. This is apparent, for example, in the height profiles of FIGS. 6 and 7 obtained using the same profilometer, which show minor oscillations in the height dimension from the shaped abrasive composites superimposed on major oscillations from the three-dimensional protrusions of the nonwoven web 114 beneath the carrier film 104. From these profiles, it is apparent that there is variability in both the diameter of the three-dimensional protrusions (e.g., $D_1$, $D_2$, and $D_3$ in FIG. 6) as well as their height (e.g., $H_1$, $H_2$, and $H_3$ in FIG. 7).

The performance of the abrasive article 100 was observed to depend in part on the aspect ratio of the three-dimensional protrusions—that is, the ratio of their average height to their average diameter. In some embodiments, the three-dimensional protrusions of the nonwoven web 114 have an average height:average diameter ratio of at least 1:200, at least 1:175, at least 1:150, at least 1:140, or at least 1:130. In some embodiments, the three-dimensional protrusions of the nonwoven web 114 have an average height:average diameter ratio of at most 1:25, at most 1:35, at most 1:50, at most 1:85, or at most 1:100.

Figure 6:
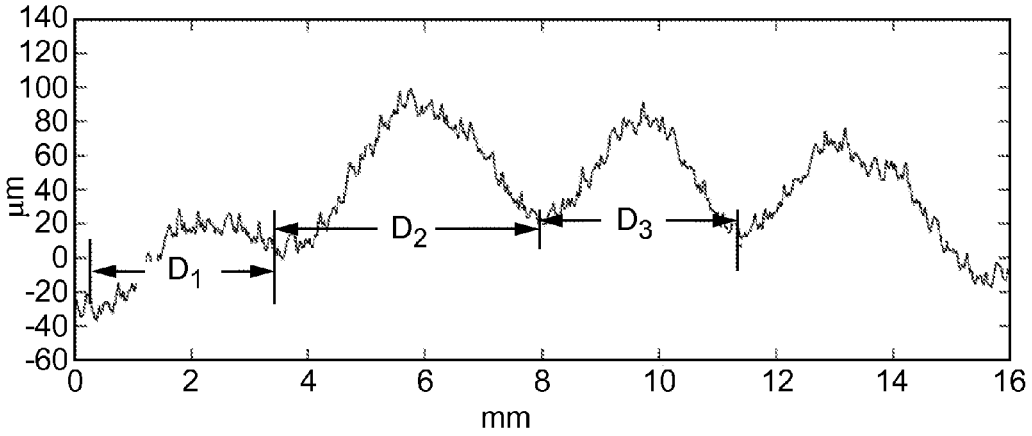
FIGS. 6 and 7 show various measurements taken from a cross-sectional profile of the abrasive article of FIG. 5.
Figure 7:
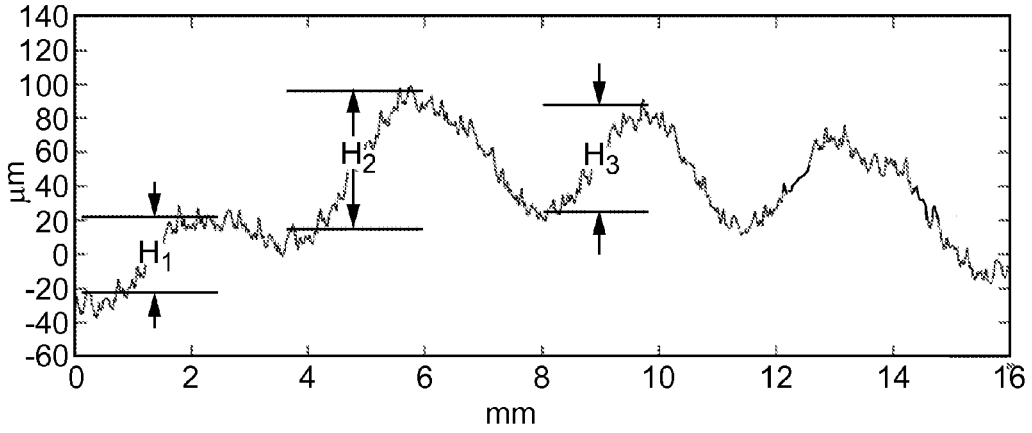

As further shown in FIGS. 6-7, the shaped features of the abrasive composite 106 are substantially smaller than the three-dimensional protrusions of the nonwoven web 114, enabling the three-dimensional pattern of the nonwoven web 114 to be expressed at the working surface of the abrasive article 100. In a preferred embodiment, the shaped features of the abrasive composite and three-dimensional protrusions of the nonwoven web have an average diameter:average diameter ratio of at least 1:50, at least 1:45, at least 1:40, at least 1:35, or at least 1:30. In the same or alternative embodiments, the shaped features of the abrasive composite and three-dimensional protrusions of the nonwoven web can have an average diameter:average diameter ratio of at most 1:5, at most 1:7, at most 1:10, at most 1:15, or at most 1:20.

Useful nonwoven webs include, for example, reticulated open fiber webs in which fibers are bonded together in a lattice-like pattern by a binder (e.g., formed by drying and/or curing a binder precursor material). The nonwoven web may be made, for example, from an air-supported construction as described in U.S. Pat. No. 2,958,593 (Hoover et al.) from a carded and cross-lapped construction, or a melt blown construction. Useful fibers include natural and synthetic fibers, and blends of the same. Useful synthetic fibers include, for example, those fibers made of polyester (for example, polyethylene-terephthalate), high or low resilience nylon (for example, hexamethylene-adipamide, polycaprolactam), polypropylene, acrylic (formed from acrylonitrile polymer), rayon, cellulose acetate, chloride copolymers of vinyl-acrylonitrile, and others. The appropriate natural fibers include those coming from cotton, wool, jute, and hemp.

In some embodiments, the nonwoven web 114 is compressible. In the same or alternative embodiments, the diameters of the nonwoven fibers may be, for example, less than or equal to 1, 2, 4, 6, 10, 13, 17, 70, 110, 120 or 200 denier, although this is not a requirement.

Finally, the last two layers shown in FIG. 1A are a second adhesive layer 116, which extends across the nonwoven web 114 opposite the first adhesive layer 112, and a foam backing 118. The second adhesive layer 116 couples the nonwoven web 114 to the foam backing 118. As before, the nonwoven web 114 may optionally be directly laminated to the foam backing 118 without need for the second adhesive layer 116.

In certain embodiments, either or both the first and second adhesive layers 112, 116 comprises a pressure sensitive adhesive.

The foam backing 118 is, in general, a compressible foam. Such foams may be formed from any of a number of compressible foam materials known in the art. In some embodiments, the foam is made from an elastic material such that the foam is resiliently compressible. Elastic foams include, for example, chloroprene rubber foams, ethylene/propylene rubber foams, butyl rubber foams, polybutadiene foams, polyisoprene foams, ethylene propylene diene monomer (EPDM) polymer foams, polyurethane foams, ethylene-vinyl acetate foams, neoprene foams, and styrene/butadiene copolymer foams. Other useful foams may include thermoplastic foams such as, for example, polyethylene foams, polypropylene foams, polybutylene foams, polystyrene foams, polyamide foams, polyester foams, and plasticized polyvinyl chloride foams.

The foam backing 118 may be open-celled or closed-celled. If the abrasive article 100 is intended for use with liquids, an open-celled foam having sufficient porosity to permit the entry of liquid is preferred. Open-celled foams enable water or some other liquid to be conveyed through the foam backing 118, preferably along both normal and transverse directions (i.e. perpendicular and parallel the working surface of the abrasive article 100, respectively). Particular examples of useful open cell foams are polyester polyurethane foams, sold under the trade designations "R 200U", "R 400U", "R 600U" and "EF3-700C" by Illbruck, Inc., Minneapolis, Minn.

Particularly suitable open-celled foams may have a number average cell count of at least 15 per cm, at least 16 per cm, at least 17 per cm, at least 18 per cm, at least 19 per cm, or at least 20 per cm. Further, these open-celled foams may have a number average cell count of at most 40 per cm, at most 38 per cm, at most 36 per cm, at most 34 per cm, at most 32 per cm, or at most 30 per cm. These same foams may display 25% compression when subjected to a uniaxial compressive stress of at least 3,500 pascals, at least 7,000 pascals, at least 10,000 pascals, at least 15,000 pascals, or at least 20,000 pascals. Further, these foams may display 25% compression when subjected to a uniaxial compressive stress of at most 138,000 pascals, at most 120,000 pascals, at most 110,000 pascals, at most 100,000 pascals, or at most 82,000 pascals.

Figure 2:
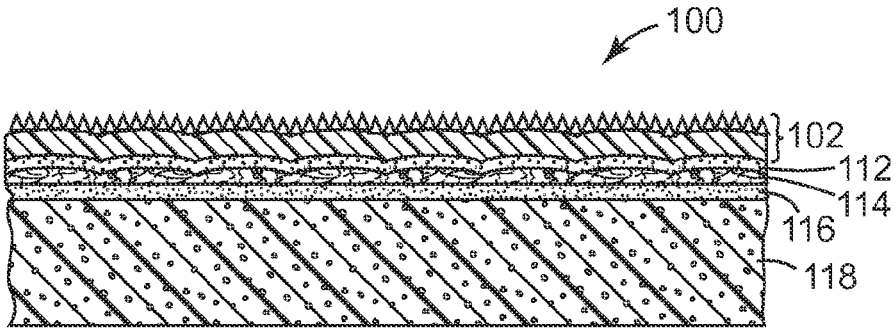
FIG. 2 is an elevational cross-sectional view of the abrasive article of FIGS. 1A and 1B with its layers collapsed.

FIG. 2 depicts the abrasive article 100 with its layers shown collapsed, the layers including the abrasive layer 102, nonwoven web 114, first and second adhesive layers 112, 116, and foam backing 118.

It is to be understood that the abrasive article 100 may be provided in any of a number of forms used by those of skill in the art. For example, the abrasive article 100 can be provided as a sheet for hand sanding or alternatively a belt or disc that can be releasably fastened to a power tool. The abrasive article 100 can also be provided in any given dimension depending on the application at hand.

Figure 3:
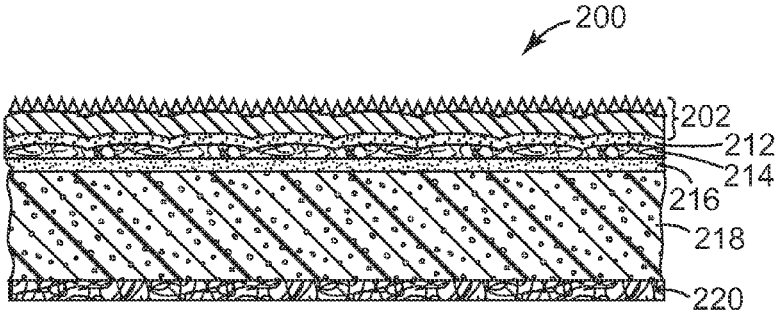
FIG. 3 is an elevational cross-sectional view of an abrasive article according to a second exemplary embodiment.

FIG. 3 shows an abrasive article 200 according to another exemplary embodiment. The abrasive article 200 has essentially all of the same constituent layers as the abrasive article 100, but further includes an attachment interface layer 220. The attachment interface layer 220 may be adhesively, chemically, or mechanically attached to the adjacent foam backing 218.

The attachment interface layer 220 facilitates attachment of the abrasive article 200 to a support structure such as, for example, a backup pad or sanding block. In exemplary applications, such as automotive finishing applications, the backup pad may be secured to a rotary or orbital power tool. The attachment interface layer 220 may be, for example, a pressure sensitive adhesive layer, a double-sided adhesive tape, a loop fabric for a hook and loop attachment as shown here (e.g., for engaging a backup or support pad having a hooked structure affixed thereto). Alternatively, the attachment interface layer 220 could include a hooked structure for a hook and loop attachment (e.g., for engaging a back up or support pad having a looped fabric affixed thereto) or an intermeshing attachment interface layer (e.g., mushroom-type interlocking fasteners designed to engage another mushroom-type interlocking fastener on a back up or support pad). Exemplary options and advantages associated with such attachment interface layers are described in U.S. Pat. No. 5,152,917 (Pieper et al); U.S. Pat. No. 5,254,194 (Ott); U.S. Pat. No. 5,201,101 (Rouser et al); and U.S. Pat. No. 6,846,232 (Braunschweig et al.) and U.S. Patent Publication 2003/0022604 (Annen et al).

Figure 4:
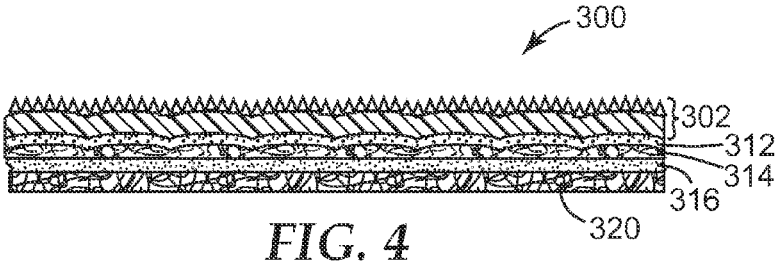
FIG. 4 is an elevational cross-sectional view of an abrasive article according to a third exemplary embodiment.

FIG. 4 shows an abrasive article 300 illustrative of another embodiment that lacks a foam backing. As shown, the abrasive article 300 has essentially all of the features of the abrasive articles 200 including a flexible abrasive layer 302, a nonwoven web 314 sandwiched between a first and second adhesive layer 312, 316, and an attachment interface layer 320. Unlike in previous embodiments, however, the second adhesive layer 316 is disposed between the nonwoven web 314 and the attachment interface layer 320, adhesively coupling these two layers to each other directly.

While the foam backing is not present here, a foam backing can be provided on the reusable backup pad to which the abrasive article 300 is attached. Advantageously, this provides a final assembly that is quite similar to those of previous embodiments, while shifting a major component, and associated costs, to the power tool. Since the foam backing is typically quite durable and the costs of including a foam backing into a disposable abrasive article are often significant, the simplified configuration of FIG. 4 could provide substantial cost savings to the user over time.

Other options and associated advantages are also possible. For example, as described in co-pending U.S. Provisional Patent Application, "ABRASIVE ARTICLE AND RELATED METHODS," Ser. No. 62/060,651 (Carter), filed on the same day as the present application, the abrasive articles herein could have one or more deeply penetrating slits extending across their working surface to further enhance distribution of liquid at the abrasive-substrate interface.

The provided abrasive articles may be used for abrading (including finishing) a substrate by hand or in combination with a power tool such as for example, a rotary sander, orbital sander, or belt sander.

The provided abrasive articles can be used provide a desired surface finish using any of a number of conventional methods known to those of skill in the art. One method of use, for example, includes applying a liquid to either the abrasive article or the substrate, and then placing the flexible abrasive article in frictional contact with the substrate. The abrasive article can then be rotated, translated or both, relative to the substrate to abrade the surface of the substrate. Depending on user technique or the type of power tool used, the abrasive article may optionally slide over the substrate in an oscillating or eccentric pattern relative to the substrate during use.

When the provided abrasive articles were placed in frictional contact with the substrate, the pattern of three-dimensional protrusions was found to provide channels that dynamically distribute the liquid along the interface between the abrasive composite and the substrate. Based on the advantageous geometry of the three-dimensional protrusions, a sufficient liquid can be retained on the flexible abrasive layer to alleviate or eliminate the problem of stiction. Liquid and swarf are compelled into the channels when pressure is applied to the permeable backing during an abrading operation, thereby facilitating their transfer away from excessively wet portions of the interface and toward comparatively drier portions of the interface. Therefore, by creating interconnected pathways that percolate across the working surface of the abrasive article, the three-dimensional protrusions control accumulation of liquid/swarf at the abrasive interface and avoid the undesirable effects of hydroplaning.

While not intended to be exhaustive, the abrasive articles and methods thereof are further exemplified by the following list of embodiments A-AH:

A. An abrasive article including: a carrier film having opposed first and second major surfaces; an abrasive composite including a plurality of shaped features, the abrasive composite being disposed on the first major surface of the carrier film; a nonwoven web disposed on the second major surface of the carrier film, where the nonwoven web and the carrier film have respective patterns of discrete, three-dimensional protrusions that are aligned with each other; and a foam backing extending across a major surface of the nonwoven web opposite the carrier film, where the foam backing is resiliently compressible.

B. The abrasive article of embodiment A, where the shaped features of the abrasive composite and three-dimensional protrusions of the nonwoven web have an average diameter:average diameter ratio ranging from 1:50 to 1:5.

C. The abrasive article of embodiment B, where the shaped features of the abrasive composite and three-dimensional protrusions of the nonwoven web have an average diameter:average diameter ratio ranging from 1:40 to 1:10.

D. The abrasive article of embodiment C, where the shaped features of the abrasive composite and three-dimensional protrusions of the nonwoven web have an average diameter:average diameter ratio ranging from 1:30 to 1:20.

E. An abrasive article including: a carrier film having opposed first and second major surfaces; an abrasive composite including a plurality of shaped features, the abrasive composite being disposed on the first major surface of the carrier film; and a nonwoven web disposed on the second major surface of the carrier film, where the nonwoven web and the carrier film have respective patterns of discrete, three-dimensional protrusions that are aligned with each other, where the shaped features of the abrasive composite and three-dimensional protrusions of the nonwoven web have an average diameter:average diameter ratio ranging from 1:50 to 1:5.

F. The abrasive article of embodiment E, where the shaped features of the abrasive composite and three-dimensional protrusions of the nonwoven web have an average diameter:average diameter ratio ranging from 1:40 to 1:10.

G. The abrasive article of embodiment F, where the shaped features of the abrasive composite and three-dimensional protrusions of the nonwoven web have an average diameter:average diameter ratio ranging from 1:20 to 1:30.

H. The abrasive article of any one of embodiments E-G, further including an attachment interface layer extending across a major surface of the nonwoven web opposite the carrier film.

I. The abrasive article of any one of embodiments A-H, further including a first adhesive layer extending across the second major surface of the carrier film, the first adhesive layer coupling the carrier film and the nonwoven web to each other.

J. The abrasive article of any one of embodiments A-D, further including a second adhesive layer disposed between the nonwoven web and the foam backing, the second adhesive layer coupling the nonwoven web and the foam backing to each other.

K. The abrasive article of embodiment H, further including a second adhesive layer disposed between the nonwoven web and the attachment interface layer, the second adhesive layer coupling the nonwoven web and the attachment interface layer to each other.

L. The abrasive article of any one of embodiments A-K, where the respective patterns of three-dimensional protrusions are replicated patterns.

M. The abrasive article of embodiment L, where the three-dimensional protrusions of the non-woven web have pre-defined shapes selected from the group consisting of: hemispheres, posts, pyramids, prisms, and combinations thereof.

N. The abrasive article of any one of embodiments A-M, where the nonwoven web is compressible.

O. The abrasive article of any one of embodiments A-N, where the nonwoven web includes a reticulated nonwoven material.

P. The abrasive article of any one of embodiments A-O, where the three-dimensional protrusions have an average height:average diameter ratio ranging from 1:200 to 1:25.

Q. The abrasive article of embodiment P, where the three-dimensional protrusions have an average height:average diameter ratio ranging from 1:150 to 1:50.

R. The abrasive article of embodiment Q, where the three-dimensional protrusions have an average height:average diameter ratio ranging from 1:130 to 1:100.

S. The abrasive article of any one of embodiments A-R, where the carrier film is conformable.

T. The abrasive article of embodiment S, where the carrier film includes a polyurethane film.

U. The abrasive article of embodiment T, where the polyurethane film has a thickness ranging from 10 micrometers to 200 micrometers.

V. The abrasive article of embodiment U, where the polyurethane carrier film has a thickness ranging from 15 micrometers to 100 micrometers.

W. The abrasive article of embodiment V, where the polyurethane carrier film has a thickness ranging from 20 micrometers to 50 micrometers.

X. The abrasive article of any one of embodiments A-W, where the foam backing includes an open-celled polyurethane foam.

Y. The abrasive article of embodiment X, where the open-celled polyurethane foam has a number average cell count ranging from 15 per centimeter to 40 per centimeter.

Z. The abrasive article of embodiment Y, where the open-celled polyurethane foam has a number average cell count ranging from 17 per centimeter to 36 per centimeter.

AA. The abrasive article of embodiment Z, where the open-celled polyurethane foam has a number average cell count ranging from 20 per centimeter to 0 per centimeter.

AB. The abrasive article of any one of embodiments X-AA, where the open-celled polyurethane foam displays a compression of 25 percent when subjected to a uniaxial compressive stress ranging from 3,500 pascals to 138,000 pascals.

AC. The abrasive article of embodiment AB, where the open-celled polyurethane foam displays a compression of 25 percent when subjected to a uniaxial compressive stress ranging from 10,000 pascals to 110,000 pascals.

AD. The abrasive article of embodiment AC, where the open-celled polyurethane foam displays a compression of 25 percent when subjected to a uniaxial compressive stress ranging from 20,000 pascals to 82,000 pascals.

AE. The abrasive article of any one of embodiments A-AD, further including an attachment interface layer disposed on a major surface of the nonwoven web opposite the carrier film.

AF. A method of abrading a substrate using the abrasive article of any one of embodiments A-AE, the method including: applying a liquid to either the abrasive article or the substrate; and placing the abrasive article in frictional contact with the substrate, whereby the pattern of three-dimensional protrusions provide channels that dynamically distribute the liquid along an interface between the abrasive composite and the substrate.

AG. A method of making an abrasive article including: disposing an abrasive composite onto a conformable carrier film to provide a coated abrasive layer; and disposing the coated abrasive layer onto a nonwoven web having a pattern of three-dimensional protrusions to transfer the pattern of three-dimensional protrusions onto a major surface of the coated abrasive layer facing away from the nonwoven web.

AH. The method of embodiment AG, further including disposing an attachment interface layer onto a major surface of the nonwoven web opposite the coated abrasive layer to allow releasable coupling between the abrasive article and a power tool.

EXAMPLES

Unless otherwise noted, all parts, percentages, ratios, etc. in the examples and the rest of the specification are by weight, and all reagents used in the examples were obtained, or are available, from general chemical suppliers such as, for example, Sigma-Aldrich Company, Saint Louis, Mo., or may be synthesized by conventional methods.

The following abbreviations are used to describe the examples:

° C.: degrees Celsius
mil: $10^{-3}$ inches
μm: micrometers
ft/min: feet per minute
m/min: meters per minute
mm: millimeters
cm: centimeters
kPa: kilopascals
psi: pounds per square inch
s: second
UV: ultraviolet
W/in: watts per inch
W/cm: watts per centimeter A-174: gamma-methacryloxypropyltrimethoxysilane, available under the trade designation "SILQUEST A174" from Momentive, Columbus, Ohio.

GC2500: a grade JIS 2500 silicon carbide abrasive mineral, commercially available under the trade designation "GC2500" from Fujimi Corp., Tualatin, Oreg.

SR339: 2-phenoxyethyl acrylate monomer available under the trade designation "SR339" from Sartomer Company, Exton, Pa.

SR351: trimethylolpropane triacrylate available under the trade designation "SR351H" from Sartomer Company.

TPO-L: acylphosphine oxide, commercially available under the trade designation "LUCERIN TPO-L" from BASF Corp. of Florham Park, N.J.

Preparation of Abrasive Slurries AS-1

A resin pre-mix was made by homogenously dispersing for 30 minutes at 20° C., the following components:

| | |
|---|---|
| TPO-L | 33.6 grams |
| A-174 | 60.0 grams |
| SR339 | 403.0 grams |
| SR351 | 607.0 grams |
| S24000 | 96.0 grams |

AS-1

958 grams GC2500 was homogeneously dispersed into 600 grams of the resin pre-mix for 15 minutes at 21° C. using a high speed shear mixer, after which the slurry was heated to 60° C., held for 2 hours, then cooled back to 21° C.

Preparation of Microreplicated Toolings MRT1

Indentations, corresponding to the microreplicated abrasive pattern seen in FIG. 4 of U.S. Pat. No. 6,200,840, were engraved into planar 30 cm sections of a nickel-plated master by means of a diamond turning machine. The engraved sections were then welded together sequentially, with the grooves of each section contiguous with the grooves of the adjacent section, and the resultant single master affixed to a drum. Polypropylene resin was then cast onto the master and extruded between a nip roll and cooled, resulting in a sheet of flexible polymeric production tool. The array of cavities formed on the surface of the polymeric production tool corresponded to the inverse pattern of the microreplicated abrasive pattern.

Example 1

Abrasive slurry AS-1 was applied by knife coating to the microreplicated polypropylene tooling MRT-1, at a coating weight of approximately 5.5 mg/cm$^2$. The slurry filled polypropylene tooling was then contacted in a nip roll onto a polyurethane elastomer film commercially available under the trade designation TEGADERM from 3M Company, St. Paul, Minn., and UV cured using a UV processor having two "D" type bulbs, from Fusion Systems Inc., Gaithersburg, Md., at 600 W/in (236 W/cm), a line speed of 70 ft/min (21.3 m/min), and a nip pressure of 60 psi (413.7 kPa). The tooling was subsequently removed to expose a microreplicated abrasive coating onto the carrier film.

A nonwoven web with protrusions of dimensions approximately 4 mm in width, 3 mm in length and 85 μm in height such as seen in FIG. 5, obtained under the product code "2E070V40P50M10," commercially available from N.R. Spuntech Industries Ltd., Hinckley, Leics., UK, had a layer of adhesive applied, commercially available under the trade designation "HS300LSE" from 3M Company, St. Paul, Minn., to both surfaces. A 90 mil (2.29 mm) layer of polyurethane foam, available under the trade designation "HYPUR-CEL S0601", from Rubberlite Inc., Huntington, W.V., was then laminated to one surface of the nonwoven web. The abrasive film was applied to the second surface of the second surface of the nonwoven web. A brushed nylon attachment system, commercially available under the trade designation "HOOKIT BACKUP PAD, Part No. 05551" from 3M Company, St. Paul, Minn., was attached to the second surface of the foam.

Example 2

Example 2 was prepared as described in Example 1, except the nonwoven web from Example 1 was substituted for a nonwoven material with protrusions of dimensions approximately 5 mm in width, 5 mm in length and 50 μm in height under the product code "2SQ70V40P50M10" commercially available from N.R. Spuntech Industries Ltd., Hinckley, Leics., UK.

Example 3

Example 3 was prepared as described in Example 1, except the nonwoven web from Example 1 was substituted for a nonwoven material with protrusions of dimensions approximately 3 mm in width, 3 mm in length and 30 μm in height under the product code "13SD50V50P40Y10" commercially available from N.R. Spuntech Industries Ltd., Hinckley, Leics., UK.

Comparative Example A

Comparative Example A was prepared as described in Example 1, except the polyurethane film was substituted with a polyurethane foam available under the trade designation "HYPUR-CEL S0601", from Rubberlite, Inc., Huntington, W.V.

Cut Test 6-inch (15.4 cm) diameter discs were die-cut from Example 1, Example 2 and Comparative Example A for the Cut test.

Abrasive performance testing was performed on a 50 cm by 50 cm (19.6 inches by 19. inches) black painted cold roll steel test panels having a "NEXA 6690" type clear coat, obtained from PPG Industries, Inc., Pitts, Pa. The panels were sprayed 24 hours prior to the test being performed. A 6 inch (15.2 cm) diameter sanding disc, trade designation "260L P1200 HOOKIT FINISHING FILM" was attached to an equally sized "HOOKIT SOFT INTERFACE PAD, PART No. 05777", which in turn was attached to a to a "HOOKIT BACKUP PAD, PART No. 05551," The disc was attached to a dual action pneumatic sander (available under the trade designation "RA 150A" from Rupes S.p.A., Italy). The panel was pre-scuffed for 1 minute. The scuffed panel was then wiped with a microfiber cloth and weighed. The 260L finishing film and the soft interface pad was replaced with a sample disc from Example 1 and Comparative Example A, the panel sprayed lightly with approximately 6 ml of water and the sanding repeated every minute for 10 minutes. After each minute, the panel was cleaned, weighed and sprayed again with a similar volume of water as initially sprayed. This was performed on 4 sample discs for each Example. The mean cut rate in grams was calculated by summing the subtraction of the initial weight of the panel from the weight recorded at each minute for each sample disc and then divided by the number of sample discs used. This is displayed in Table 1. Cumulative cut in grams was calculated by successively summing the cut at each minute from Table 1, to that of the minute before. For example, the cut measured at 2 minutes was added to that measured at 1 minute, to give cumulative cut at 2 minutes. This was repeated for each of the 10 minutes and is reported in Table 2. Observations made during the test are provided in Table 2.

TABLE 1

Mean cut, in grams

| | Example 1 | Example 2 | Example 3 | Comparative Example A |
|---|---|---|---|---|
| 1 min | 0.36 | 0.26 | 0.27 | 0.48 |
| 2 min | 0.30 | 0.17 | 0.13 | 0.21 |
| 3 min | 0.29 | 0.11 | 0.09 | 0.16 |
| 4 min | 0.27 | 0.09 | 0.07 | 0.12 |
| 5 min | 0.24 | 0.09 | 0.06 | 0.10 |
| 6 min | 0.22 | 0.06 | 0.07 | 0.07 |
| 7 min | 0.21 | 0.06 | 0.05 | 0.08 |
| 8 min | 0.19 | 0.05 | 0.05 | 0.07 |
| 9 min | 0.16 | 0.03 | 0.03 | 0.06 |
| 10 min | 0.13 | 0.04 | 0.03 | 0.05 |

TABLE 2

Cumulative cut, in grams, and observations

| | Example 1 | Example 2 | Example 3 | Comparative Example A |
|---|---|---|---|---|
| 1 min | 0.36 | 0.26 | 0.27 | 0.48 |
| 2 min | 0.65 | 0.43 | 0.4 | 0.69 |
| 3 min | 0.94 | 0.54 | 0.49 | 0.86 |
| 4 min | 1.21 | 0.63 | 0.56 | 0.98 |
| 5 min | 1.45 | 0.72 | 0.62 | 1.07 |
| 6 min | 1.67 | 0.78 | 0.69 | 1.14 |
| 7 min | 1.88 | 0.84 | 0.74 | 1.22 |
| 8 min | 2.07 | 0.89 | 0.79 | 1.29 |
| 9 min | 2.23 | 0.92 | 0.82 | 1.35 |
| 10 min | 2.36 | 0.96 | 0.85 | 1.40 |
| Observations | Good initial cut, lifetime of disc at least 10 min. Some decrease in cut seen towards 7 min. No stiction or hydroplaning | Good initial cut, lifetime of disc at least 10 min. Decrease in cut seen after 5 min. Occasional stiction or hydroplaning | Good initial cut, lifetime of disc at least 10 min. Low cut throughout life of disc. | Good initial cut, lifetime of disc approximately 4 min, disc disintegrating and seen to stop cutting. Some stiction and hydroplaning. |

All patents and patent applications mentioned above are hereby expressly incorporated by reference. Although the invention herein has been described with reference to particular embodiments, it is to be understood that these embodiments are merely illustrative of the principles and applications of the present invention. It will be apparent to those skilled in the art that various modifications and variations can be made to the method and apparatus of the present invention without departing from the spirit and scope of the invention. Thus, it is intended that the present invention include modifications and variations that are within the scope of the appended claims and their equivalents.

What is claimed is:

1. An abrasive article comprising:

a carrier film having opposed first and second major surfaces;

an abrasive composite comprising a plurality of shaped features, the abrasive composite being disposed on the first major surface of the carrier film;

a nonwoven web disposed on the second major surface of the carrier film, wherein the nonwoven web and the carrier film have respective patterns of discrete, three-dimensional protrusions that are aligned with each other; and a foam backing extending across a major surface of the nonwoven web opposite the carrier film, wherein the foam backing is resiliently compressible.

2. The abrasive article of claim 1, wherein the shaped features of the abrasive composite and three-dimensional protrusions of the nonwoven web have an average diameter: average diameter ratio ranging from 1:50 to 1:5.

3. The abrasive article of claim 2, wherein the shaped features of the abrasive composite and three-dimensional protrusions of the nonwoven web have an average diameter: average diameter ratio ranging from 1:20 to 1:30.

4. An abrasive article comprising:

a carrier film having opposed first and second major surfaces;

an abrasive composite comprising a plurality of shaped features, the abrasive composite being disposed on the first major surface of the carrier film; and a nonwoven web disposed on the second major surface of the carrier film, wherein the nonwoven web and the carrier film have respective patterns of discrete, three-dimensional protrusions that are aligned with each other, wherein the shaped features of the abrasive composite and three-dimensional protrusions of the nonwoven web have an average diameter:average diameter ratio ranging from 1:5 to 1:50.

5. The abrasive article of claim 4, wherein the shaped features of the abrasive composite and three-dimensional protrusions of the nonwoven web have an average diameter: average diameter ratio ranging from 1:30 to 1:20.

6. The abrasive article of claim 4, further comprising an attachment interface layer extending across a major surface of the nonwoven web opposite the carrier film.

7. The abrasive article of claim 1, further comprising a first adhesive layer extending across the second major surface of the carrier film, the first adhesive layer coupling the carrier film and the nonwoven web to each other.

8. The abrasive article of claim 1, further comprising a second adhesive layer disposed between the nonwoven web and the foam backing, the second adhesive layer coupling the nonwoven web and the foam backing to each other.

9. The abrasive article of claim 6, further comprising a second adhesive layer disposed between the nonwoven web and the attachment interface layer, the second adhesive layer coupling the nonwoven web and the attachment interface layer to each other.

10. The abrasive article of claim 1, wherein the three-dimensional protrusions have an average height:average diameter ratio ranging from 1:200 to 1:25.

11. The abrasive article of claim 10, wherein the three-dimensional protrusions have an average height:average diameter ratio ranging from 1:130 to 1:100.

12. The abrasive article of claim 1, further comprising an attachment interface layer disposed on a major surface of the nonwoven web opposite the carrier film.

13. A method of abrading a substrate using the abrasive article of claim 1, the method comprising:

applying a liquid to either the abrasive article or the substrate; and placing the abrasive article in frictional contact with the substrate, whereby the pattern of three-dimensional protrusions provide channels that dynamically distribute the liquid along an interface between the abrasive composite and the substrate.

14. A method of making an abrasive article comprising:

disposing an abrasive composite onto a conformable carrier film to provide a coated abrasive layer; and disposing the coated abrasive layer onto a nonwoven web having a pattern of three-dimensional protrusions to transfer the pattern of three-dimensional protrusions onto a major surface of the coated abrasive layer facing away from the nonwoven web.

15. The method of claim 14, further comprising disposing an attachment interface layer onto a major surface of the nonwoven web opposite the coated abrasive layer to allow releasable coupling between the abrasive article and a power tool.

* * * * *